United States Patent [19]

Keller

[11] Patent Number: 4,949,637

[45] Date of Patent: Aug. 21, 1990

[54] SELF-METERING DAMPENING SYSTEM FOR A LITHOGRAPHIC PRESS

[76] Inventor: James J. Keller, 7405 Inwood Rd., Dallas, Tex. 75209

[21] Appl. No.: 282,264

[22] Filed: Dec. 9, 1988

Related U.S. Application Data

[63] Continuation-in-part of Ser. No. 131,111, Dec. 10, 1987, abandoned.

[51] Int. Cl.[5] ..... B41F 7/26; B41F 7/40

[52] U.S. Cl. ..... 101/148; 101/352

[58] Field of Search ..... 101/348, 349, 350, 351, 101/352, 363, 148, 207, 208–210

[56] References Cited

U.S. PATENT DOCUMENTS

| | | | |
|---|---|---|---|
| 2,220,278 | 11/1940 | Rapport | 101/148 |
| 2,238,050 | 4/1941 | Goedike | 101/148 |
| 2,622,521 | 12/1952 | Larsen | 101/148 |
| 2,690,119 | 9/1954 | Black | 101/148 |
| 2,703,525 | 3/1955 | Stempel | 101/148 |
| 2,733,654 | 2/1956 | Rogers | 101/148 |
| 3,039,386 | 6/1962 | Trisler | 101/352 |
| 3,139,826 | 7/1964 | Rainwater | 101/348 |
| 3,146,706 | 9/1964 | Tonkin et al. | 101/148 |
| 3,150,589 | 9/1964 | Senogles | 101/350 |
| 3,168,037 | 2/1965 | Dahlgren | 101/148 |
| 3,283,707 | 11/1966 | Greubel et al. | 101/148 |
| 3,296,964 | 1/1967 | Orr | 101/348 |
| 3,404,625 | 10/1968 | White | 101/148 |
| 3,431,842 | 3/1969 | Winkler et al. | 101/142 |
| 3,433,155 | 3/1969 | Norton | 101/148 |
| 3,552,311 | 1/1971 | Petri | 101/148 |
| 3,563,173 | 2/1971 | Harless | 101/148 |
| 3,604,349 | 9/1971 | Sejeck | 101/148 |
| 3,614,927 | 10/1971 | Jurny | 101/148 |
| 3,688,694 | 9/1972 | Preuss | 101/148 |
| 3,724,047 | 4/1973 | Peterson | 101/348 |
| 3,731,624 | 5/1973 | Kancko et al. | 101/148 X |
| 3,902,417 | 9/1975 | Fischer | 101/148 |
| 4,036,131 | 7/1977 | Elmore | 101/247 |
| 4,455,938 | 6/1984 | Loudon | 101/148 |

*Primary Examiner*—J. Reed Fisher

*Attorney, Agent, or Firm*—Richards, Medlock & Andrews

[57] ABSTRACT

A dampening system for a lithographic press in which a train of rollers delivers dampening fluid from a dampening fluid pan to the plate cylinder of the lithographic press is provided. The train of rollers comprises a hard rubber pan roller, a rubber transfer roller of medium hardness, and a relatively soft rubber water form roller. The transfer roller is mounted in parallel relation to the pan roller and can be moved towards or away from the pan roller in order to vary the pressure therebetween and to thus meter the dampening fluid delivered to the plate cylinder. Dampening fluid is conveyed from the pan roller, to the transfer roller, to the water form roller, and finally to the plate cylinder. The pan roller and water form roller are driven at the surface speed of the plate cylinder through a gear train.

23 Claims, 2 Drawing Sheets

SELF-METERING DAMPENING SYSTEM FOR A LITHOGRAPHIC PRESS

RELATED APPLICATION

This application for patent is a continuation-in-part of Ser. No. 131,111 filed on Dec. 10, 1987, now abandoned.

TECHNICAL FIELD

This invention relates to a dampening system for use with lithographic printing presses, and is particularly directed to an improved, self-metering dampening system for delivery of dampening fluid directly to the plate cylinder of a lithographic press.

BACKGROUND OF THE INVENTION

The use of dampening systems is well-known to the lithographic press art. The principal objective of a dampening system is to apply a uniform and evenly distributed quantity of dampening fluid to the plate cylinder of a lithographic press in order to ensure a high quality printed image. If too much dampening fluid is applied to the plate cylinder, the ink will become diluted and/or emulsified, causing the printed image to have a blurred or faded appearance. If too little dampening fluid is applied to the plate cylinder, ink will tend to migrate into non-printing areas, thus compromising the printed image. Thus, it is necessary to have a dampening system which provides a uniform film of dampening fluid to the plate cylinder at a desirable rate.

One method for applying dampening fluid to the lithographic plate is described in U.S. Pat. No. 3,168,037 to Dahlgren. The Dahlgren system employs a water pan in which a rubber-coated metering roller is disposed. A chrome-plated transfer roller is disposed parallel to and tangentially communicates with the metering roller. An applicator roller is disposed parallel to and tangentially communicates with the transfer roller such that a thin film of dampening fluid is ultimately transferred from the water pan to the applicator roller. A separate ink train delivers ink to the form roller which, in turn, delivers both ink and dampening fluid to the plate cylinder. Dahlgren controls the volume of dampening fluid delivered by the system by varying the pressure between the metering and transfer rollers and between the transfer and applicator rollers. An independent drive means is provided to rotate the transfer roller and the applicator roller at different speeds to cause slip therebetween. The slippage further regulates the volume of dampening fluid delivered to the lithographic press by the system.

A second method for the application of a dampening fluid to the plate cylinder of a lithographic press is disclosed in U.S. Pat. No. 4,455,983 to Loudon. Loudon employs a dampening form roller and a metering roller. The rollers are positioned in a parallel relation such that they are in tangential contact with one another. A nip is formed immediately above the points of contact between the two rollers. A reservoir of dampening fluid is maintained at the nip such that a film of dampening fluid is allowed to pass between the rollers. The fluid film is directed along the water form roller to the plate cylinder. Loudon also employs a system for returning excess dampening fluid to the reservoir.

Loudon and Dahlgren disclose what are referred to as "continuous" dampeners. Other dampeners which are considered to be "non-continuous" commonly employ a ductor roller to direct dampening fluid across the width of the plate cylinder. Continuous dampening systems are considered to be superior to non-continuous dampeners due to their ability to deliver a continuous, relatively thin film of dampening fluid to the plate cylinder.

SUMMARY OF THE INVENTION

The dampening system of the present invention includes a pan roller, a transfer roller, and a water form roller mounted in a frame. The transfer roller is rotatably mounted in a hanger support element which, in turn, is pivotally mounted to the frame about the axis of the pan roller. The hanger support element can be rotated between a first position in which the transfer roller tangentially communicates with the water form roller and a second position in which the transfer roller is spaced from the water form roller. The pan roller is partially disposed within a watering pan such that the pan roller is in fluid contact with a dampening fluid. Each of the rollers in the dampening system is constructed of rubber and is rotatably driven at the surface speed of the plate cylinder. The volume of dampening fluid delivered by the dampening system can be controlled by manually adjusting the pressure between the transfer roller and the pan roller through the use of an adjustment means. All rollers of the dampening system carry both ink and dampening fluid in normal use. An oscillating roller is also provided in order to ensure that an even and homogeneous film of ink and water is carried by the water form roller.

DESCRIPTION OF THE DRAWINGS

A more complete understanding of the present invention and its advantages will be apparent from the following Detailed Description read in conjunction with the accompanying drawings, in which.

DETAILED DESCRIPTION

Figure 1:
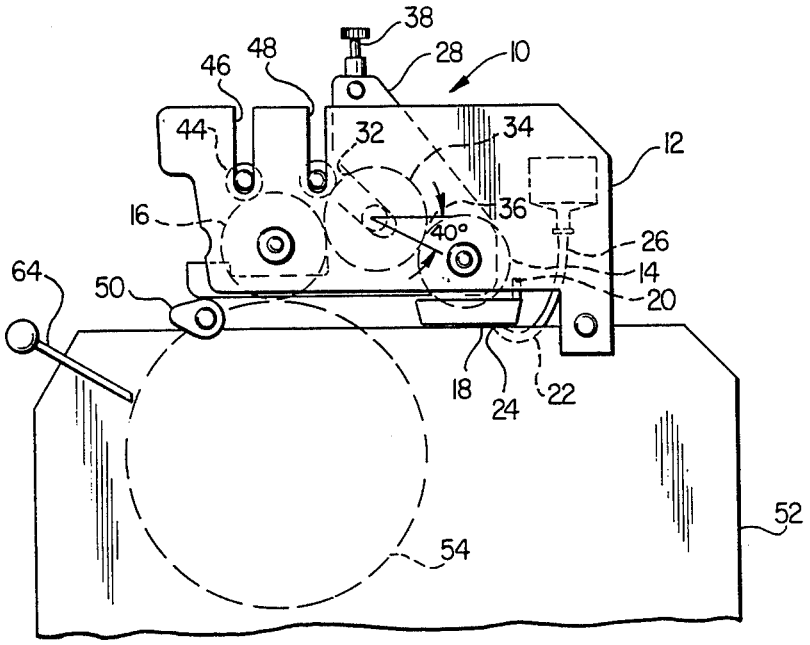
FIG. 1 is a side plan view of the dampening system of the present invention.

A self-metering dampening system for use with a lithographic press is generally indicated at 10 of FIG. 1. Dampening system 10 includes frame members 12 in which pan roller 14 and water form roller 16 are rotatably mounted. Pan roller 14 and water form roller 16 are disposed in parallel relation on frame members 12.

Pan roller 14 is preferably constructed of a relatively hard rubber material. It has been found that it is preferable to have a pan roller which has an inkreceptive, smooth hard surface. In particular, rubber rollers having a Shore D durometer hardness value of 90–100 have been found to provide optimal characteristics. However, it is to be appreciated that pan roller 14 can be constructed of any material having the characteristics discussed above.

Water form roller 16 is also preferably constructed of a rubber material. However, it has been found that optimal dampening characteristics are obtained when water form roller 16 has a Shore D durometer hardness value of 30–35. It is desirable to avoid the use of softer rubber, as shown in the prior art, due to its tendency to absorb the dampening fluid and swell. Again, however, it is to be appreciated that water form roller 16 can be constructed of any material having the desired characteristics discussed above.

Water pan 18 is threadably mounted on frame members 12 such that pan roller 14 is partially disposed within water pan 18. Water pan 18 can be threadably mounted to frame 12 through apertures 20 disposed at each end of water pan 18. Dampening fluid is fed into water pan 18 via fluid feed hose 22. Hose 22 is in fluid communication with the dampening fluid in water pan 18 through aperture 24 in the bottom of water pan 18. Distal end 26 of hose 22 is connected to a dampening fluid reservoir of any conventional structure. In another preferred embodiment, the dampening fluid level within water pan 18 is maintained through the use of a dampening fluid reservoir mounted in water pan 18 such that air will enter the reservoir when the fluid level in water pan 18 drops below a predetermined level, causing dampening fluid to be delivered from the reservoir into water pan 18. Any other means for maintaining a level of dampening fluid in water pan 18 can be used without departing from the scope of this invention.

Figure 2:
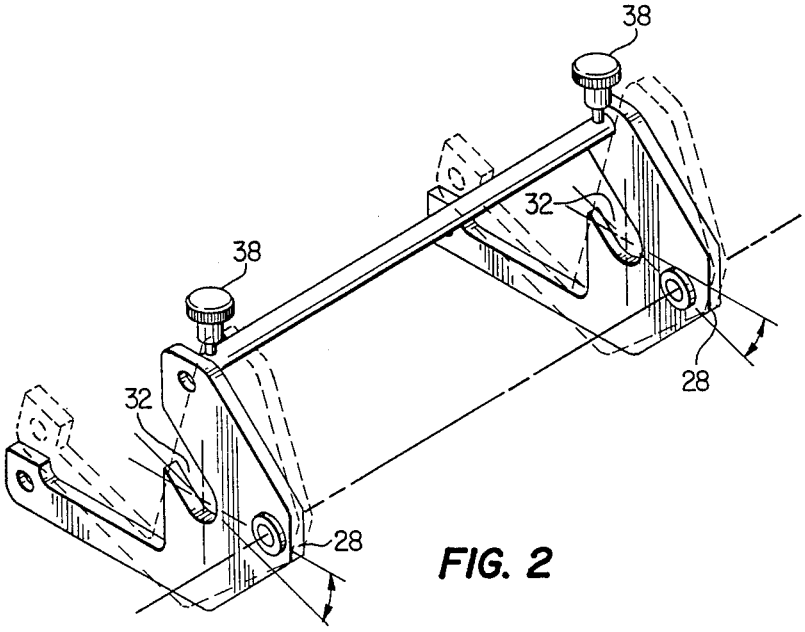
FIG. 2 is an perspective view of the hanger support element of the dampening system.
Figure 3:
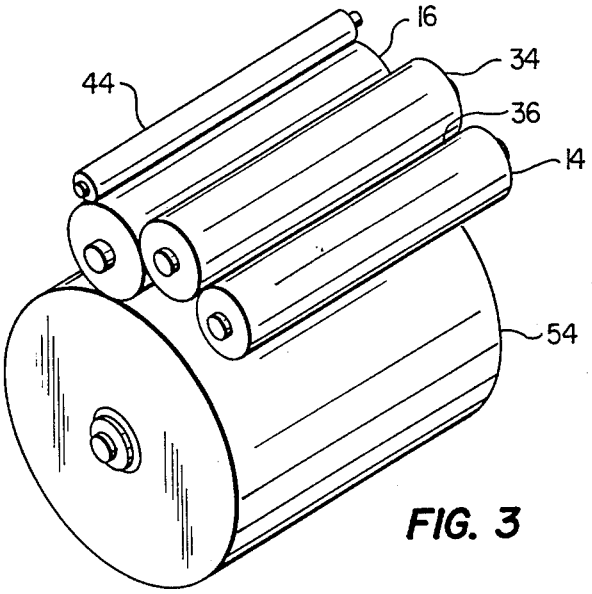
FIG. 3 is a perspective view of the relative orientations of the rollers of the dampening system.
Figure 4:
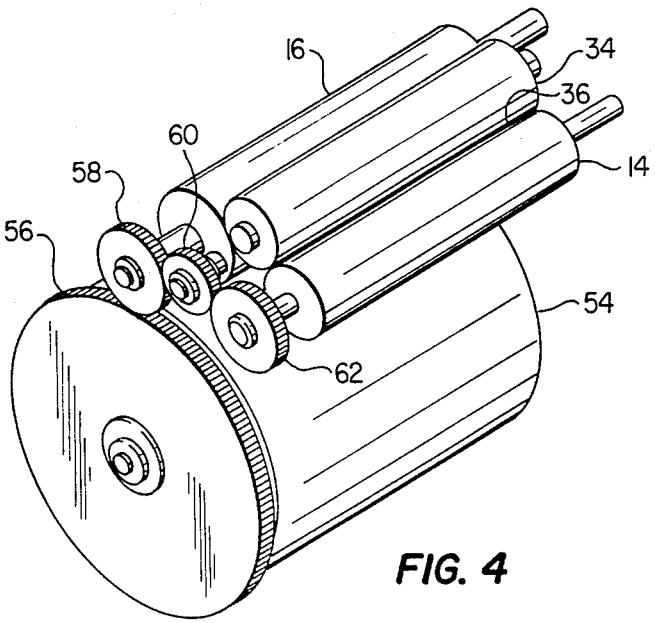
FIG. 4 is a perspective view of the gear train of the dampening system.

Hanger support elements 28 are pivotally mounted on frame members 12 about longitudinal axis 30 of pan roller 14. Slots 32 are formed on hanger support elements 28 as best seen in FIG. 2. Transfer roller 34 is rotatably and slidably mounted in slots 32. Transfer roller 34 is disposed in parallel relation to pan roller 14 and water form roller 16.

Transfer roller 34 is preferably constructed of a rubber material of medium hardness. A Shore D durometer hardness value of 40-50 has been found to provide optimal dampening characteristics. In addition, transfer roller 34 preferably has a substantially nonporous, glass-like finish. Such a finish can be achieved, by way of example, by coating a rubber roller with a urethane epoxy. It is to be appreciated that transfer roller 34 can be constructed of any material or materials having the desired characteristics.

Hanger support elements 28 can be pivoted between a first position, shown in FIG. 2, and a second position, shown in broken lines in FIG. 2. In its first position, hanger support elements 28 are disposed such that transfer roller 34 tangentially contacts water form roller 16. Due to the parallel orientation of transfer roller 34 and water form roller 16, they contact one another across their widths. Also in the first position, transfer roller 34 tangentially contacts pan roller 14. Again, as transfer roller 34 and pan roller 14 are in parallel relation, they are in contact across their widths.

Nip 36 is formed at the line of contact between pan roller 14 and transfer roller 34. In operation, pan roller 14 directs a film of dampening fluid upwardly from water pan 18 to nip 36. Nip 36 provides a metering effect, thus producing a thin even film of dampening fluid on transfer roller 34. The thickness of the film of dampening fluid transferred from pan roller 14 to transfer roller 34 can be controlled by adjusting the pressure exerted on pan roller 14 by transfer roller 34. This adjustment can be made by selectively positioning transfer roller 34 along slots 32. In one preferred embodiment, transfer roller 34 is manually positioned along slots 32 and threadably secured in the desired position along slots 32 through the use of screws 35 mounted at each end of transfer roller 34. Screws 35 engage hanger support elements 28, thereby releasably retaining transfer roller 34 relative to pan roller 14.

In another preferred embodiment, screws 38 are mounted on hanger support elements 28 as depicted in FIG. 2. Screws 38 extend through structural bar 39 and engage support member 35 of transfer roller 34. It is to be appreciated that when screws 38 are threadably tightened, transfer roller 34 is urged downwardly, thus increasing the pressure between pan roller 14 and transfer roller 34. It should be appreciated that any means for selectively positioning transfer roller 34 along slots 32 can be used without departing from the scope of this invention.

It has been found that optimal metering is obtained when pan roller 14 is positioned at an elevation different from that of transfer roller 34. In particular, it is preferable that angle 40 between the respective axes of rotation of transfer roller 34 and pan roller 14 is between 8° and 38°. It is thus desirable to construct frame members 12 and hanger support elements 28 such that pan roller 14 and transfer roller 34 are within this range.

Slots 32 are inclined relative to the horizontal. In a preferred embodiment, angle 42 is 30°. Transfer roller 34 is disposed relative to water form roller 16 such that they remain substantially in tangential contact when hanger support elements 28 are in their first positions. The contact between water form roller 16 and transfer roller 34 causes dampening fluid on transfer roller 34 to be transferred to water form roller 16.

An oscillating roller 44 can be rotatably mounted between frame members 12. In a preferred embodiment, oscillating roller 44 is disposed in parallel relation to pan roller 14, water form roller 16, and transfer roller 34. Oscillating roller 44 is preferably constructed of relatively hard rubber. Oscillating roller 44 can be selectively positioned in first vertical channels 46 or in second vertical channels 48 formed in frame members 12. When oscillating roller 44 is disposed in first vertical channels 46, it is in tangential contact with water form roller 16. In turn, when oscillating roller 44 is selectively disposed in second vertical channels 48, it is in tangential contact with transfer roller 34. Selective placement of oscillating roller 44 in either vertical channels 46 or vertical channels 48 is achieved by manually moving roller 44 from one position to the other. The purpose of oscillating roller 44 is to ensure that the film of ink and dampening fluid on water form roller 16 and transfer roller 34 is homogeneous in thickness and in composition. It is to be appreciated that the selfmetering dampening system of the present invention will function without the use of oscillating rollers.

In a second preferred embodiment, two oscillating rollers 44 are disposed between frame members 12. One oscillating roller is disposed in first vertical channel 46 and one oscillating roller is disposed in second vertical channel 48. This embodiment has been found to be particularly useful when large quantities of ink are being used in the printing process.

Hanger support elements 28 are rotated between their first and second positions through the use of a two-position eccentric cam mechanism 50. As hanger support elements 28 are rotated, transfer roller 34 becomes spaced from water form roller 16. In this second position, the dampening system of the present invention is essentially disengaged from the lithographic plate cylinder as no dampening fluid can be conveyed from transfer roller 34 to water form roller 16. As stated above, hanger support element 28 is pivotally mounted on frame members 12 about pan roller 14. Thus, it is apparent that transfer roller 34 remains in contact with pan roller 14 when hanger support element 28 is rotated from its first position to its second position.

Dampening system 10 is mountable on a lithographic press 52 such that water form roller 16 tangentially contacts plate cylinder 54. In operation, ink is delivered to the plate cylinder by means of an ink train. Any known ink train may be used in conjunction with the present invention, so long as it delivers ink directly to the plate cylinder. Dampening fluid is directed by dampening system 10 from water pan 18 to plate cylinder 54 as described in detail above. Ink is simultaneously conveyed from plate cylinder 54 to water form roller 16, transfer roller 34, and pan roller 14. That is, the rollers of dampening system 10 carry both ink and dampening fluid in operation. It has been found that as a greater amount of ink is conveyed to plate cylinder 54, there is a concurrent increase in the amount of ink on water form roller 16, transfer roller 34, and pan roller 14. The increased quantity of ink on pan roller 14 causes a greater volume of dampening fluid to be forced through nip 36 and ultimately conveyed to water form roller 16 and plate cylinder 54. This characteristic of dampening system 10 implies that only nominal adjustments of transfer roller 34 are necessary during operation.

Plate cylinder gears 56 are disposed on plate cylinder 54. In addition, water form roller gears 58, and pan roller gears 62 are disposed on water form roller 16 and pan roller 14, respectively. Water form roller gears 58 are constructed to cooperatively mate with plate cylinder gears 56 such that water form roller 16 is driven at the surface speed of plate cylinder 54. Water form roller gears also cooperatively mate with idler gears 60 which in turn cooperatively mate with pan roller gears 62 such that pan roller 34 is driven at the surface speed of plate cylinder 54. In operation, there is no slippage between the rollers of the present invention. Transfer roller 34 is frictionally driven by pan roller 14 at the surface speed of plate cylinder 54. It will be appreciated that plate cylinder 54 and transfer roller 34 rotate in the same direction while water form 16 and pan roller 14 rotate in the opposite direction. It will also be appreciated that numerous variations of the gear train may be used without departing from the scope of the invention, so long as all rollers are driven at the surface speed of the plate cylinder.

As the rotational speed of plate cylinder 54 is increased, the rotational speed of pan roller 14 will be simultaneously increased, causing the volume of dampening fluid delivered by dampening system 10 to be increased. This feature, along with the system's tendency to allow more dampening fluid through the system as the amount of ink on plate cylinder 54 is increased, as discussed above, makes dampening system 10 substantially self-metering. Only minor changes of pressure between pan roller 14 and transfer roller 34 will be necessary in normal use.

Dampening system 10 is preferably pivotally mounted on a lithographic press such that water form roller 16 can be spaced from plate cylinder 54 for purposes of clean-up or pre-wetting. Lever 64 is mounted on the lithographic press 52 to lift dampening system 10 from engagement with plate cylinder 54.

While the dampening system of the present invention has been described in detail herein, it will be evident that various and further modifications are possible without departing from the spirit and scope of the invention.

What is claimed is:

1. An apparatus for continuously supplying a dampening fluid to the plate of a lithographic press comprising:

a frame;

a dampening fluid reservoir;

a pan roller rotatably mounted in said frame, said pan roller disposed in contact with dampening fluid in said dampening fluid reservoir;

a transfer roller tangentially contacting and parallel to said pan roller;

a water form roller rotatably mounted in said frame, said water form roller positioned to tangentially contact the plate of said lithographic press and said water form roller mounted in parallel relation to said pan roller;

a hanger support element pivotally mounted on said frame, said transfer roller being rotatably mounted in said hanger support element, and said hanger support element being pivotable between a first position and a second position, whereby in said first position said transfer roller tangentially contacts said water form roller and said transfer roller tangentially contacts and is frictionally driven by said pan roller, and whereby in said second position said transfer roller is spaced from said water form roller;

a means for adjusting the pressure between said pan roller and said transfer roller, said means for adjusting mounted on said hanger support element; and a means for driving said pan roller and said water form roller at the surface speed of the plate of said lithographic press.

2. The apparatus for continuously supplying a dampening fluid to the plate of a lithographic press of claim 1, wherein said pan roller, said transfer roller, and said water form roller, are constructed of rubber.

3. The apparatus for continuously supplying a dampening fluid to the plate of a lithographic press of claim 2, wherein said pan roller has a Shore D durometer hardness value of 90–100.

4. The apparatus for continuously supplying a dampening fluid to the plate of a lithographic press of claim 2, wherein said water form roller has a Shore D durometer hardness value of 30–35.

5. The apparatus for continuously supplying a dampening fluid to the plate of a lithographic press of claim 2, wherein said transfer roller has a Shore D durometer hardness value of 40–50.

6. The apparatus for continuously supplying a dampening fluid to the plate of a lithographic press of claim 5, wherein said transfer roller has a glass-like, non-porous finish.

7. The apparatus for continuously supplying a dampening fluid to the plate of a lithographic press of claim 6, wherein said glass-like, non-porous finish is a urethane epoxy.

8. The apparatus for continuously supplying a dampening fluid to the plate of a lithographic press of claim 1, wherein said hanger support element pivots relative to said frame about the axis of rotation of said pan roller.

9. The apparatus for continuously supplying a dampening fluid to the plate of a lithographic press of claim 8, wherein said hanger support element pivots between said first and said second positions by selectively positioning an eccentric cam means mounted on the lithographic press.

10. The apparatus for continuously supplying a dampening fluid to the plate of a lithographic press of claim 1, wherein said means for adjusting the pressure between said pan roller and said transfer roller comprises a pair of screw means mounted on said hanger support element whereby said transfer roller can be threadably urged toward said pan roller.

11. The apparatus for continuously supplying a dampening fluid to the plate of a lithographic press of claim 10, wherein slots are formed on said hanger support element whereby said transfer roller can be selectively positioned along said slots.

12. The apparatus for continuously supplying a dampening fluid to the plate of a lithographic press of claim 1, wherein said means for driving said pan roller and said water form roller comprises a plurality of intermeshing gears driven by the rotation of the plate cylinder of said lithographic press.

13. The apparatus for continuously supplying a dampening fluid to the plate of a lithographic press of claim 1, wherein an oscillating roller is rotatably mounted on said frame and tangentially contacts said water form roller.

14. The apparatus for continuously supplying a dampening fluid to the plate of a lithographic press of claim 13, wherein said oscillating roller can be selectively positioned in an first position or in a second position, whereby said oscillating roller tangentially contacts said water form roller in said first position and contacts said transfer roller in said second position.

15. The apparatus for continuously supplying a dampening fluid to the plate of a lithographic press of claim 13, wherein a second oscillating roller is rotatably mounted in said frame, said second oscillating roller tangentially contacting said transfer roller.

16. An apparatus for continuously supplying a dampening fluid to the plate of a lithographic press comprising:

a frame;

a dampening fluid reservoir;

an elastomeric pan roller rotatably mounted in said frame, said pan roller disposed in contact with dampening fluid in said dampening fluid reservoir;

an elastomeric transfer roller mounted parallel to and tangentially contacting said pan roller;

an elastomeric water form roller rotatably mounted in said frame, said water form roller mounted parallel to said pan roller and parallel to the plate of said lithographic press, said water form roller positioned to tangentially contact the plate of said lithographic press;

a hanger support element pivotally mounted on said frame, said hanger support element being pivotable between a first position and a second position, said transfer roller being rotatably mounted on said hanger support element whereby in said first position said transfer roller tangentially contacts said water form roller and said transfer roller tangentially contacts and is frictionally driven by said pan roller, and whereby in said second position said transfer roller is spaced from said water form roller;

a means for adjusting the pressure between said pan roller and said transfer roller, said means for adjusting mounted on said hanger support element; and a means for driving said pan roller and said water form roller at the surface speed of the plate of said lithographic press.

17. The apparatus for continuously supplying a dampening fluid to the plate of a lithographic press of claim 16, wherein said pan roller has a Shore D durometer hardness value of 9–100.

18. The apparatus for continuously supplying a dampening fluid to the plate of a lithographic press of claim 16, wherein said transfer roller has a Shore D durometer hardness value of 40–50.

19. The apparatus for continuously supplying a dampening fluid to the plate of a lithographic press of claim 16, wherein said water form roller has a Shore D durometer hardness value of 30–35.

20. The apparatus for continuously supplying a dampening fluid to the plate of a lithographic press of claim 16, wherein said transfer roller has a glass-like, non-porous finish.

21. The apparatus for continuously supplying a dampening fluid to the plate of a lithographic press of claim 16, wherein an elastomeric oscillating roller is rotatably mounted on said frame, said oscillating roller disposed parallel to and tangentially contacting said water form roller.

22. The apparatus for continuously supplying a dampening fluid to the plate of a lithographic press of claim 21, wherein said oscillating roller can be selectively positioned in a first position or a second position on said frame, whereby said oscillating roller tangentially contacts said water form roller when in said first position and whereby said oscillating roller tangentially contacts said transfer roller when in said second position.

23. The apparatus for continuously supplying a dampening fluid to the plate of a lithographic press of claim 21, wherein a second oscillating roller is rotatably mounted in said frame, said second oscillating roller tangentially contacting said transfer roller.

* * * * *